US007712425B2

(12) United States Patent
Basta

(10) Patent No.: US 7,712,425 B2
(45) **Date of Patent: *May 11, 2010**

(54) FLOATING DRIVE ON BOAT DOCKING APPARATUS

(76) Inventor: Samuel T. Basta, 1800 132nd Pl. SE., Bellevue, WA (US) 98005

( * ) Notice: Subject to any disclaimer, the term of this patent is extended or adjusted under 35 U.S.C. 154(b) by 0 days.

This patent is subject to a terminal disclaimer.

(21) Appl. No.: 11/725,297

(22) Filed: Mar. 19, 2007

(65) Prior Publication Data

US 2007/0169675 A1 Jul. 26, 2007

Related U.S. Application Data

(63) Continuation of application No. 11/324,010, filed on Dec. 31, 2005, now Pat. No. 7,210,420.

(51) Int. Cl.
*B63C 7/00* (2006.01)

(52) U.S. Cl. ..... 114/44; 114/125; 114/263

(58) Field of Classification Search ..... 114/44, 114/125, 263

See application file for complete search history.

(56) References Cited

U.S. PATENT DOCUMENTS

| | | | | | |
|---|---|---|---|---|---|
| 3,054,373 | A * | 9/1962 | Ripley | 114/125 |
| 3,683,630 | A * | 8/1972 | Alexandre | 405/97 |
| 3,788,616 | A * | 1/1974 | Clough, Jr. | 261/64.1 |
| 4,037,421 | A * | 7/1977 | Whitley, Jr. | 405/3 |
| 6,131,528 | A * | 10/2000 | Meek et al. | 114/44 |
| 6,209,474 | B1 * | 4/2001 | Foss et al. | 206/403 |
| 6,602,022 | B1 * | 8/2003 | Wilkins | 405/3 |
| 7,021,861 | B2 * | 4/2006 | Basta | 405/3 |
| 7,210,420 | B1 * | 5/2007 | Basta | 114/44 |

* cited by examiner

*Primary Examiner*—Stephen Avila
(74) *Attorney, Agent, or Firm*—Black Lowe & Graham PLLC

(57) ABSTRACT

An improved floating boat lift incorporates a passive hydraulic pivoting lift mechanism, onto which a boat can be driven and positioned ready for storage using only the motive power of the boat itself. The passive hydraulic pivoting lift mechanism provides mechanical advantage in the pivoting action of the apparatus by way of passive hydraulic action, while at the same time dampening pivoting of the apparatus. Embodiments further allow for adjusting the elevation of the pivot point relative to the surface of the body of water by way of adjusting the buoyancy of the pivoting lift mechanism.

13 Claims, 6 Drawing Sheets

FLOATING DRIVE ON BOAT DOCKING APPARATUS

This application is a continuation of the U.S. patent application Ser. No. 11/324,010 filed 31 Dec. 2005 issuing as U.S. Pat. No. 7,210,420 on 1 May 2007, which application is incorporated herein by reference.

FIELD OF THE INVENTION

This invention relates to an improvement in floating boat lift apparatus.

BACKGROUND OF INVENTION

Various apparatus have been devised for dry-docking boats. Pleasure boats of the kind to which the present invention is particularly adapted are thought of, for purpose of the present description, as being generally within the range of about fifteen feet to twenty-four feet in length and within the range of about 800 pounds to 6000 pounds in weight. Apparatus for docking pleasure boats has been associated with both non-floating as well as floating docks. The use of such apparatus is intended to facilitate removal of a boat from the water, maintaining the boat in a stored position elevated above the water, and for launching of the boat into the water.

Among the many methods known and used for lifting boats for dry docking, floating lifts (such as set forth in U.S. Pat. No. 7,021,861, issued Apr. 4, 2006 to the inventor of the present invention) are known to have particular advantages. Secured or anchored in some fashion, such lifts can provide dry docking for boats in areas which were formerly open water. Floating upon the body of water, such lifts provide convenient dry docking at a constant level above the surface, in contrast with fixed lifts whose use may at times be rendered difficult or impractical due to varying seasonal depth of the body of water. Floating lifts can provide dry docking in bodies of water in which securing a fixed boat lift is difficult, as in deep muddy or sandy bottoms. Floating lifts may also be relocated with considerably greater ease than fixed boat lifts.

An improved form of floating boat lift apparatus is illustrated in U.S. Pat. No. 6,602,022 to Wilkins, incorporated herein by reference, in which a tilting apparatus, installed in a floating boat well, receives a boat driven by its operator. The apparatus is then tilted about a pivot point, thereby elevating the boat in dry dock. In some embodiments, the lift mechanism, responsive to the change in weight distribution on the apparatus caused by the receipt of the boat, pivots on its own and elevates the boat. In other embodiments, after the boat has been received by the apparatus, it is necessary to use a winch or other mechanical assist to tilt the mechanism to elevate the boat.

Advantageously over the prior art, Wilkins provides an apparatus that incorporates a single pivotal frame onto which a boat can be driven and positioned ready for storage using only the motive power of the boat itself and which can be pivoted so as to either elevate the boat above the water for storage or discharge the boat into the water for further use.

However, the operation of Wilkins boat lift is subject to several shortcomings. First, the elevation of the pivot point relative to the boat well (and therefore its elevation relative to the surface of the water) is fixed in Wilkins lift. It is desirable to allow adjustment of the elevation of the pivot point relative to the surface of the water in order both to optimize the tilting operation of the lift and to provide adequate clearance of the boat from the water for dry dock purposes when the lift is in the elevated position.

Second, no additional mechanical advantage is employed by Wilkins to augment the leverage provided by the change in weight distribution caused by receipt of the boat. Indeed, in embodiments elevating the boat above a relatively low height above the water (approximately six inches) or when elevating heavier boats, the Wilkins lift does not tilt on its own, instead requiring the use of the aforesaid winch or other mechanical means to effect tilting of the mechanism to elevate the boat. It is desirable to provide augmentation of the leverage provided by the weight of the boat, in order to allow the lift to be pivoted to the elevated position with greater ease and to provide for embodiments in which boats may be elevated above relatively low heights by operation of the apparatus on its own without the need for additional mechanical means to effect tilting.

Third, Wilkins does not provide a damping functionality for his tilting apparatus: in embodiments relying on change in weight distribution to effect tilting, as the apparatus is tilted to elevate the boat and the center of gravity of the mechanism passes over-center of the pivot point, the lift apparatus settles to the elevated position in an abrupt fashion which can be jarring for the boat operator and tends to cause wear and fatigue of the lift mechanism.

What is needed is an improved floating boat lift, having a pivoting lift mechanism onto which a boat can be driven and positioned ready for storage using only the motive power of the boat itself, but which also further provides mechanical advantage to augment the leverage provided by the change in weight distribution caused by receipt of the boat while providing a damping functionality to mitigate abrupt pivoting of the apparatus. What is needed further is such a floating boat lift that affords a means of adjusting the elevation of the lifting pivot point relative to the body of water.

SUMMARY OF THE INVENTION

The present invention is an improved floating boat lift incorporating a passive hydraulic pivoting lift mechanism, onto which a boat can be driven and positioned ready for storage using only the motive power of the boat itself. The passive hydraulic pivoting lift mechanism provides mechanical advantage in the pivoting action of the apparatus by way of passive hydraulic action, while at the same time dampening pivoting of the apparatus. Some embodiments further provide means for adjusting the elevation of the pivot point relative to the surface of the body of water by way of adjusting the buoyancy of the pivoting lift mechanism.

BRIEF DESCRIPTION OF THE DRAWINGS

Other objects, advantages, features and characteristics of the present invention, as well as methods, operation and function of related elements of structure, and the combination of parts and economies of deployment, will become apparent upon consideration of the following description and claims with reference to the accompanying drawings, all of which form a part of this specification, wherein:

DETAILED DESCRIPTION OF THE PREFERRED EMBODIMENTS

Figure 1:
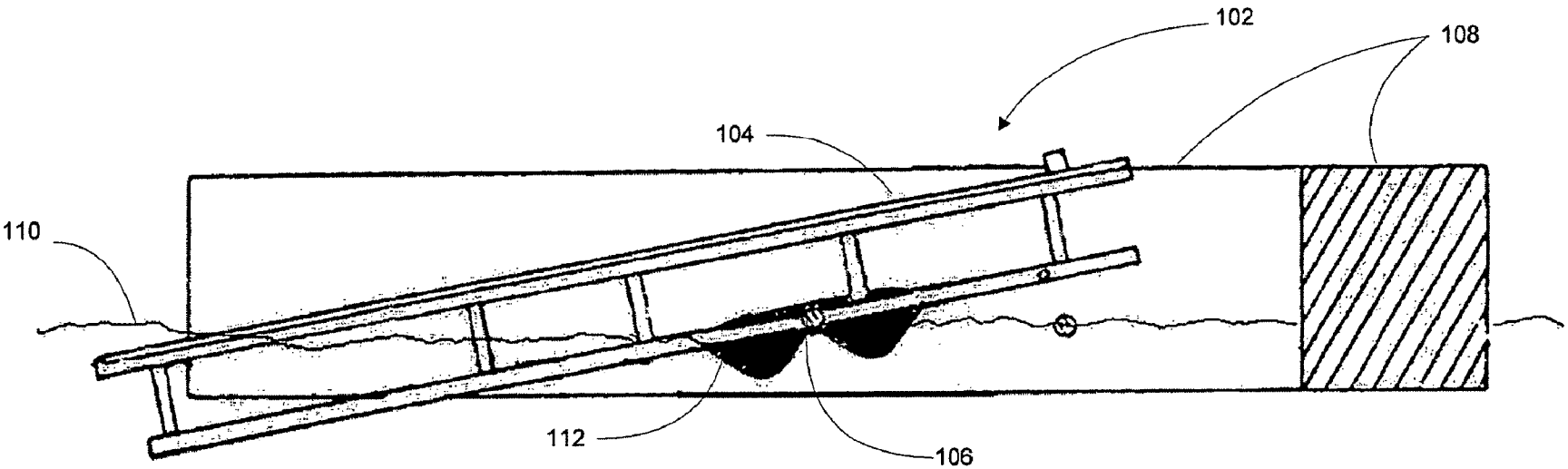
FIG. 1 is a side elevation section view of the present invention illustrating the lift positioned for receipt of a boat.

Turning to FIG. 1, illustrated is a floating boat lift 102, positioned for receipt of a boat, comprised of a frame 104, pivoting about a pivot point 106 which is buoyantly suspended by floating means 108 floating upon the surface 110 of a body of water. As is known to those in the art, floating means 108 may comprise a well formed by conjoined floating dock segments. Alternatively, floating means 108 my comprise pontoons specifically fashioned for the purpose of providing flotation for the lift. In any case, as will become clear from examination of the subsequent drawings, the lifting functionality of such floating boat lifts derives from the ability of the frame to pivot about a buoyantly suspended pivot point. Improving upon the prior art, the present invention further provides a passive hydraulic contrivance 112, affixed to and pivoting with the frame.

Figure 2:
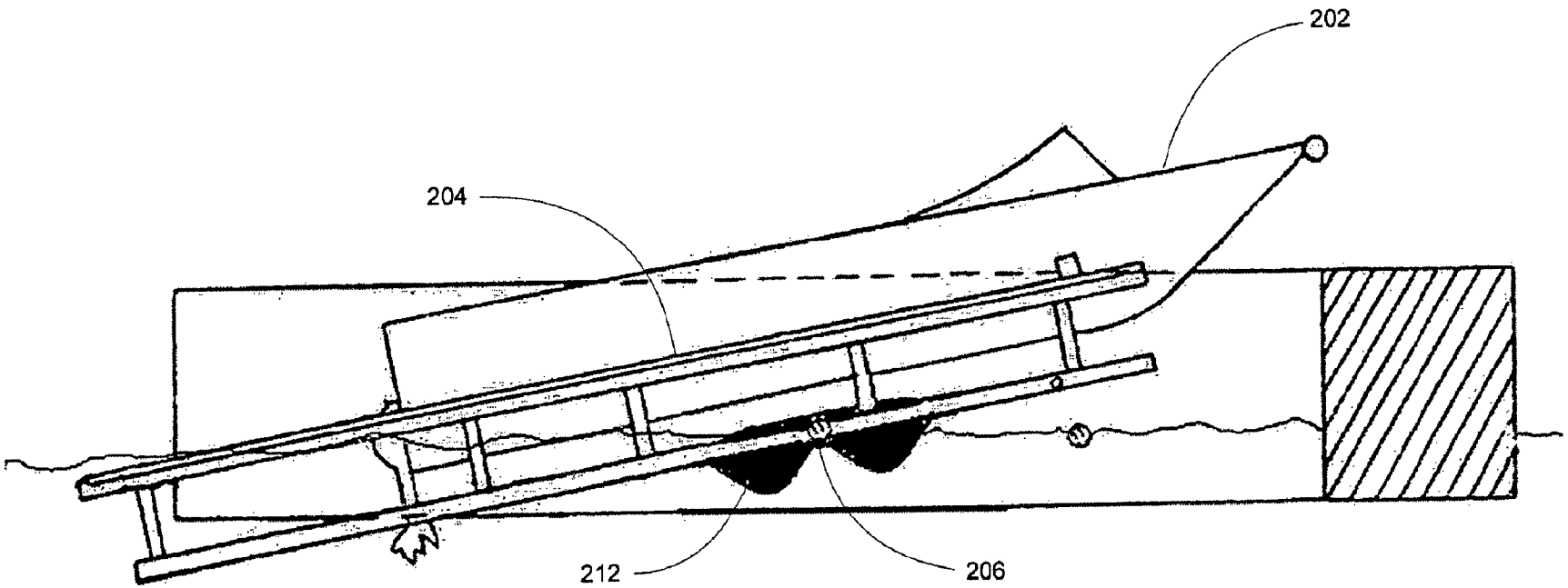
FIG. 2 is a side elevation section view of the present invention after the boat has been driven onto the frame under its own motive power.

Turning now to FIG. 2, illustrated is the lift immediately after a boat 202 has been driven onto it under its own motive power. Receipt of boat 202 by frame 204 results in distribution of weight on frame 204 forward of pivot point 206, causing frame 204 to pivot upon pivot point 206. As will be explained further in reference to subsequent drawings, hydraulic contrivance 212 both provides mechanical advantage to the pivoting action and also dampens the speed with which pivoting occurs.

Figure 3:
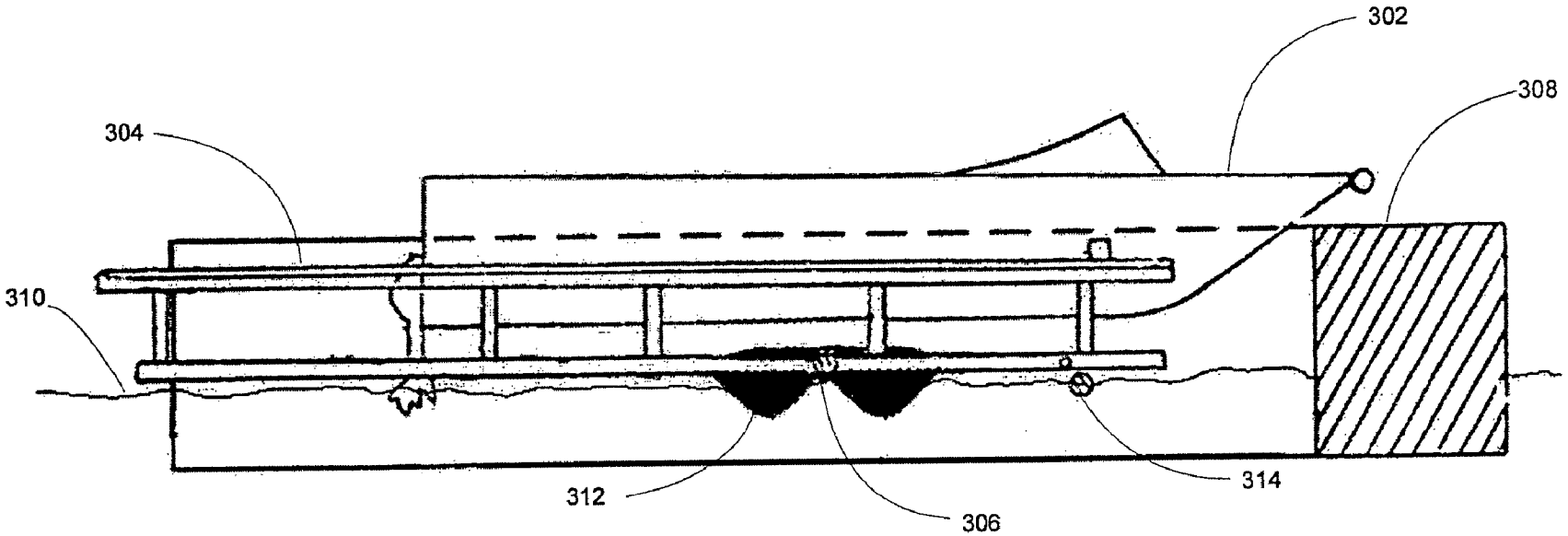
FIG. 3 is a side elevation showing the lift after it has pivoted, thereby lifting the boat.

In FIG. 3, frame 304 has fully pivoted on pivot point 306, coming to rest upon restraining bar 314. Resting on frame 304, boat 302 is buoyantly suspended by floating means 308 above the surface 310 of the body of water. The operation of passive hydraulic contrivance 312 is explained in reference to the cross-sectional views presented in FIG. 4.

Figure 4A:
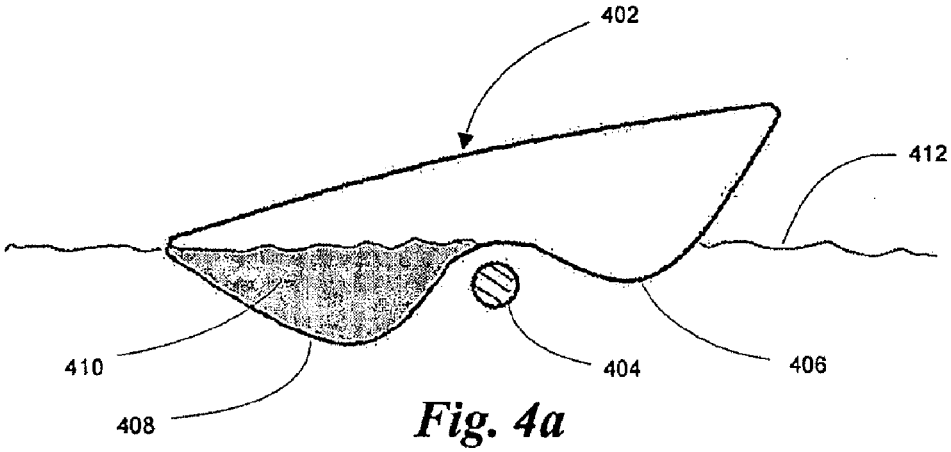
FIGS. 4*a*, 4*b* and 4*c* are cross-sectional views showing operation of the passive hydraulic mechanism in an embodiment of the present invention.

FIG. 4*a* illustrates the passive hydraulic contrivance 402 in a position prior to pivoting of the frame about pivot point 404, in particular as when the lift is positioned for receipt of a boat (FIG. 1). As illustrated, contrivance 402 is comprised of two communicating chambers, 406 and 408, and in this position chamber 408 is lower than chamber 406. Contrivance 402 is partially filled with ballast water 410, which fills lower chamber 408, while upper chamber 406 is empty.

Figure 4B:
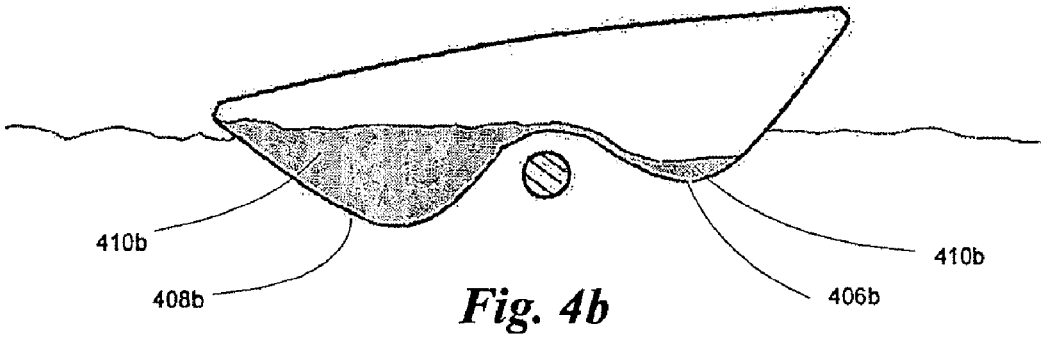

In FIG. 4*b*, the frame (not illustrated) and the contrivance 402 have begun to pivot, as is the case when the frame, receiving a boat driven onto the frame under the boat's own motive power, pivots about pivot point 404 because of the forward change in weight distribution (FIG. 2). Ballast water 410 flows from chamber 408 to chamber 406, further distributing weight forward of pivot point 404, thereby providing mechanical advantage to the pivoting action. However, because the flow of water 410 from chamber 408 into chamber 406 is not instantaneous, at the same time contrivance 402 resists rapid pivoting about pivot point 404 by virtue of the weight of ballast water 410 remaining in chamber 408 and, in some embodiments, the buoyancy of the portion of chamber 406 that remains yet unfilled.

Figure 4C:
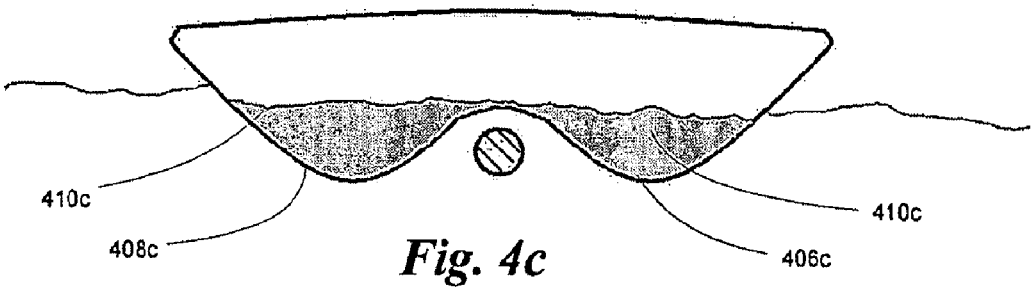

In FIG. 4*c*, the frame has fully pivoted, coming to rest against its restraint (314 in FIG. 3), and the level of ballast water 410 is equalized between chamber 406 and chamber 408.

While one embodiment is depicted, it will be appreciated by those of skill in the art that embodiments of the present invention may employ a wide variety of passive hydraulic contrivances that provide the mechanical advantage and dampening action taught herein. For example, the contrivance may comprise more than two chambers. Furthermore, the shape and size of the chambers may vary widely. Yet further, the amount of ballast within the contrivance may be varied, and ballast need not be limited to water. All that is required for such a contrivance is that it pivot with or in response to the pivoting of the frame of the lift, and that, with such pivoting, ballast flows gradually to augment the force provided by the weight distribution about the pivot point.

Figure 5A:
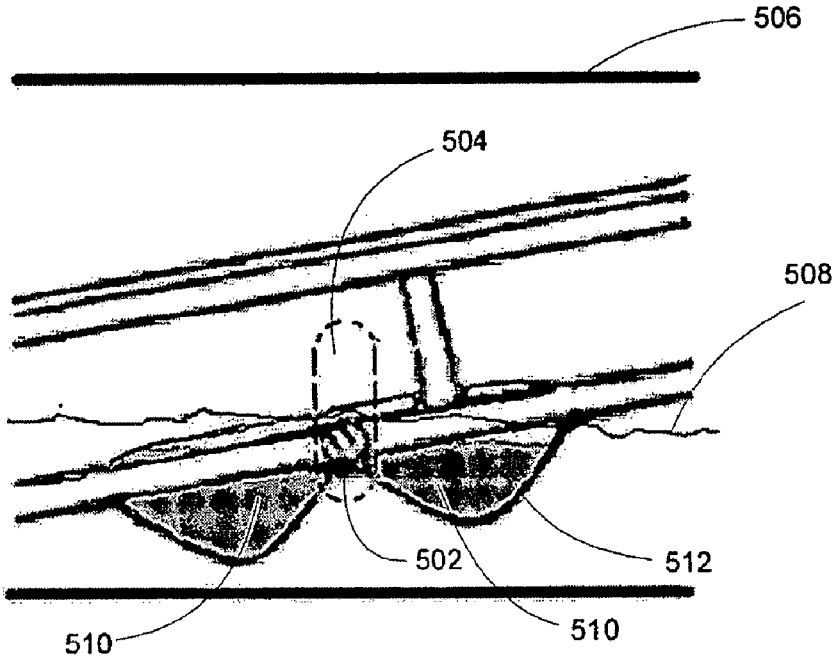
FIGS. 5*a* and 5*b* are cross-sectional views of an embodiment of the present invention permitting adjustment of the elevation of the pivot point relative to the body of water.
Figure 5B:
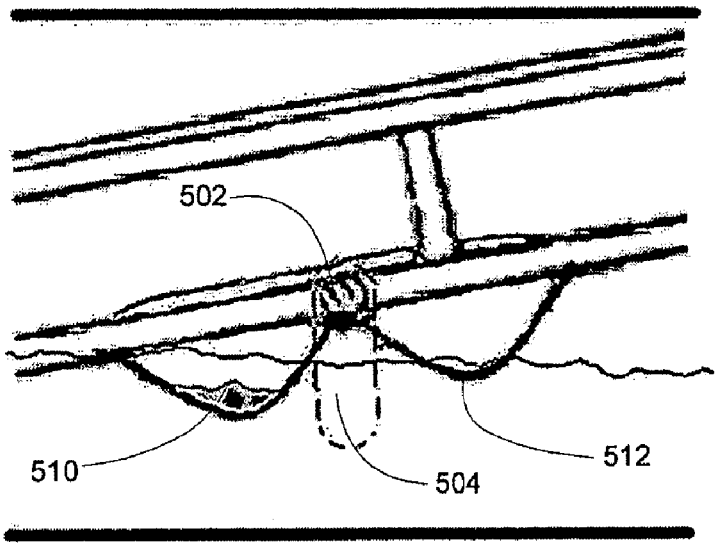

FIG. 5 illustrates a further advantage some embodiments of the invention may derive from the hydraulic contrivance. In such embodiments, pivot point 502 is releasably secured at height selected by the user within a vertical channel 504 disposed within floating means 506. The height of pivot point 502 above the surface 508 of the body of water may be adjusted by the user by releasing pivot point 502 within channel 504 and varying the amount of ballast 510 within contrivance 512. More ballast will cause pivot point 502 to be lower in relation to the surface 508 of the body of water, as in FIG. 5*a*, while, with less ballast, the contrivance provides buoyancy to raise pivot point 502 higher above the surface 508 of the body of water, as in FIG. 5*b*. When, by varying ballast 510 in contrivance 512, the user has established a desired height for the pivot point, and hence of the frame for receiving the boat (FIG. 1) and of the boat when the lift has pivoted (FIG. 3), the user then again releasably secures pivot point 502 at such height within channel 504.

Figure 6A:
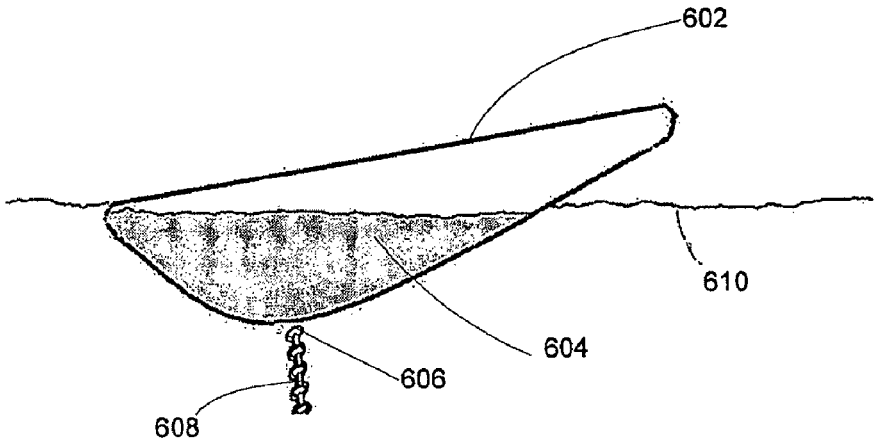
FIGS. 6*a*, 6*b* and 6*c* depict cross-sectional views of an alternative embodiment of the present invention.

An alternative embodiment of the present invention is depicted in cross section in FIG. 6. In this embodiment, the contrivance itself functions both as the frame and the floating means for the pivoting lift. In FIG. 6*a*, lift 602 is a hollow vessel, partially filled with ballast 604, tilted upward for receipt of a boat, and anchored at a pivot point 606 via chain 608 to the floor of the body of water upon whose surface 610 the lift floats.

Figure 6B:
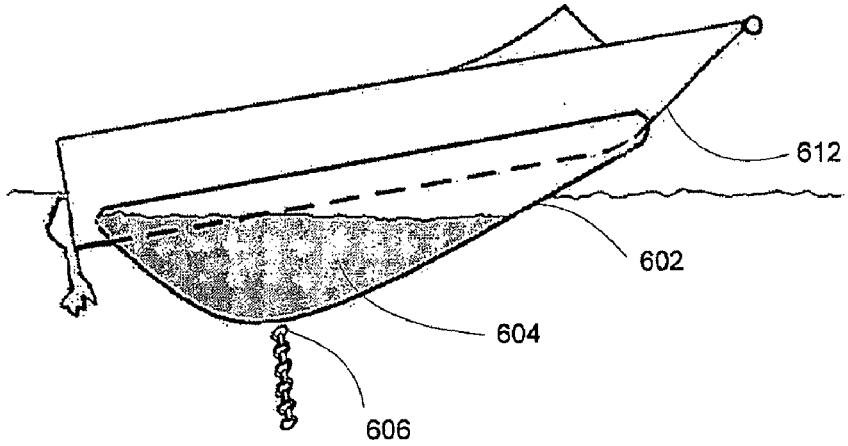

In FIG. 6*b*, lift 602 has received a boat 612 driven onto the lift under the boat's own motive power. The change in weight distribution resulting from receipt of boat 612 causes lift 602 to pivot about the pivot point 606, causing ballast 604 to flow toward the front of the lift, further distributing weight forward of the pivot point and thereby providing mechanical advantage to the pivoting of lift 602.

Figure 6C:
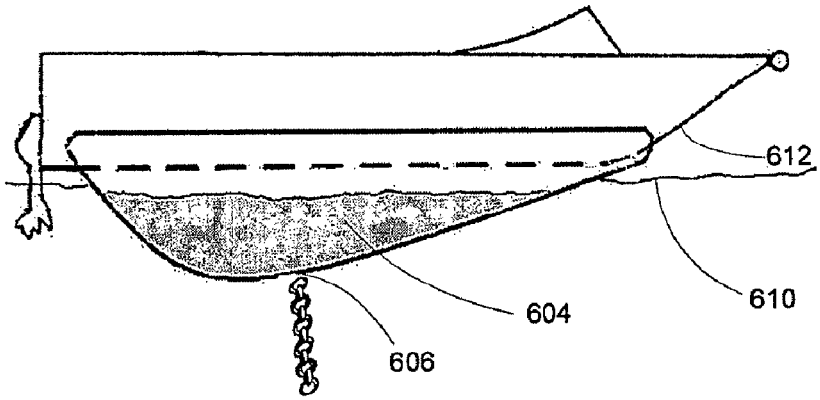

FIG. 6*c* depicts lift 602 after completion of pivoting, whereby ballast 604 has flowed within the lift so that weight is balanced on either side of pivot point 606, thereby leveling and raising boat 612 above the surface 610 of the body of water.

As taught in the foregoing discussion, the present invention, employing a passive hydraulic contrivance, improves upon the prior art floating boat lift by providing both mechanical advantage and damping action to the pivoting functionality of such a lift. Further, embodiments of the present invention facilitate user adjustment of the elevation of the lift pivot point in relation to the surface of the body of water.

Although the detailed descriptions above contain many specifics, these should not be construed as limiting the scope of the invention but as merely providing illustrations of some of the presently preferred embodiments of this invention. Various other embodiments and ramifications are possible within its scope, a number of which are discussed in general terms above.

While the invention has been described with a certain degree of particularity, it should be recognized that elements thereof may be altered by persons skilled in the art without departing from the spirit and scope of the invention. Accordingly, the present invention is not intended to be limited to the specific forms set forth herein, but on the contrary, it is intended to cover such alternatives, modifications and equivalents as can be reasonably included within the scope of the invention. The invention is limited only by the following claims and their equivalents.

I claim:

1. A floating boat lift, comprising:

a hollow vessel configured to change its orientation in response to receiving a boat for support on the vessel, the vessel defining a hollow lower chamber configured to contain a quantity of liquid ballast; and a hollow upper chamber communicating with the lower chamber, the communication being constricted such that the liquid ballast can move in a manner that is not instantaneous between the upper chamber and the lower chamber in response to the orientation of the hollow vessel; the vessel comprising:

a stationary frame portion having a pivot point;

a rotating frame portion having a rear end and a forward end, the rear end being configured to receive the boat in movement onto the vessel while in a first position, the forward end being configured to hold the boat positioned ready for storage in a second position, the rotating frame portion being affixed to the vessel and rotatably attached to the stationary frame portion at the pivot point.

2. The boat lift of claim 1; wherein:

the stationary frame portion is affixed to at least one lift float.

3. The boat lift of claim 1, wherein:

the pivot point is adjustably displaceable on the stationary frame portion.

4. The boat lift of claim 1, wherein:

the rotating frame portion holds the boat in a position ready for storage when a center of weight distribution of the boat rests between the pivot point and the forward end; and the rotating frame portion moves to a receiving position when the center of weight distribution is not between the pivot point and the forward end.

5. The boat lift of claim 1, wherein the stationary frame portion is displaceable from a surface of a body of water by addition or removal of liquid ballast from the vessel.

6. The boat lift of claim 1, wherein;

a restraining bar supports the vessel when the vessel is positioned ready for storage, but allows the rotating frame portion to return to the first position.

7. A method for lifting a boat from a surface of a body of water, the method comprising:

moving a boat having a center of weight distribution from a first position on a buoyant vessel where the center of weight distribution is generally over a rear end the vessel comprises, the rear end being configured to receive the boat in movement onto the vessel, to a second position where the center of weight distribution is generally over a forward end the vessel comprises, the forward end being configured to hold the boat positioned ready for storage;

allowing the vessel to rotate in response to moving the boat from the first position to the second position; and impeding instantaneous movement of a quantity of liquid ballast at a constriction in the communication that at least one lower chamber the vessel defines to at least one upper chamber the vessel defines, the liquid ballast moving in response to rotation of the vessel from the first position to the second position.

8. The method of claim 7, wherein:

the vessel comprises a rotating frame portion affixed to the vessel and hingedly attached to a stationary frame portion at a pivot point; and allowing the vessel to rotate includes allowing the vessel to rotate about the pivot point.

9. The method of claim 8, further comprising:

adjusting the pivot point relative to the surface of the body of water.

10. The method of claim 7, the method further comprising:

displacing the rotating frame portion relative to the surface of the water by varying the quantity of liquid ballast.

11. The method of claim 10, wherein the vessel is further configured to stably contain the ballast only in the lower chamber in the first position and in the upper chamber in the second position such that the vessel will tend only to the first and second positions.

12. The method of the claim 7, further comprising:

limiting the rotation the first position past the second position by means of a restraining bar.

13. The method of claim 7, further comprising:

floating the stationary frame on lift floats.

* * * * *